US008156890B2

(12) United States Patent
Kuwana et al.

(10) Patent No.: US 8,156,890 B2
(45) Date of Patent: Apr. 17, 2012

(54) DEVICE FOR PREVENTING WINDING-UP OF SHEET METAL IN CONTINUOUS HOT-DIPPING BATH

(75) Inventors: Tatsuya Kuwana, Tokyo (JP); Hirohisa Kawamura, Tokyo (JP); Hiroyuki Tanaka, Tokyo (JP); Tsuyoshi Tominaga, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 656 days.

(21) Appl. No.: 12/302,472

(22) PCT Filed: May 25, 2007

(86) PCT No.: PCT/JP2007/061147

§ 371 (c)(1),
(2), (4) Date: Nov. 25, 2008

(87) PCT Pub. No.: WO2007/139206

PCT Pub. Date: Dec. 6, 2007

(65) Prior Publication Data

US 2009/0183674 A1 Jul. 23, 2009

(30) Foreign Application Priority Data

May 26, 2006 (JP) ..... 2006-146518

(51) Int. Cl.

| | |
|---|---|
| ***B05C 3/12*** | (2006.01) |
| ***B05C 3/00*** | (2006.01) |
| ***B05C 19/02*** | (2006.01) |
| *B05D 1/18* | (2006.01) |

(52) U.S. Cl. ..... 118/428; 118/424; 118/429; 118/419

(58) Field of Classification Search ..... 118/429, 118/424, 428; 427/431, 433, 434.2–434.5, 427/436

See application file for complete search history.

(56) References Cited

U.S. PATENT DOCUMENTS

| | | | | |
|---|---|---|---|---|
| 2,742,019 | A * | 4/1956 | Queer, Sr. | 118/122 |
| 4,275,098 | A * | 6/1981 | Gunji et al. | 427/345 |
| 5,284,520 | A * | 2/1994 | Tanaka | 118/600 |
| 5,587,017 | A * | 12/1996 | Yamanaka et al. | 118/424 |
| 5,961,285 | A * | 10/1999 | Meneice et al. | 415/200 |
| 6,426,122 | B1 * | 7/2002 | Ishii et al. | 427/433 |
| 7,361,225 | B2 * | 4/2008 | Yamamoto | 118/429 |

FOREIGN PATENT DOCUMENTS

JP 6-21331 B2 2/1991

(Continued)

OTHER PUBLICATIONS

Translation of JP 2001140050 (2001).*

(Continued)

*Primary Examiner* — Dah-Wei Yuan
*Assistant Examiner* — K Kurple
(74) *Attorney, Agent, or Firm* — Birch, Stewart, Kolasch & Birch, LLP

(57) ABSTRACT

A system for prevention of stirred up dross in continuous hot-dip plating bath of a metal sheet characterized by placing flow regulating members partially separated from each other under a sink roll at the two side wall surfaces of a hot-dip plating bath which axial ends of the sink roll face so that said members contact the wall surfaces and thereby suppressing the flow of hot dip metal ascending or descending along the wall surfaces.

17 Claims, 8 Drawing Sheets

FOREIGN PATENT DOCUMENTS

| | | | | |
|---|---|---|---|---|
| JP | 5-38045 | Y2 | | 7/1991 |
| JP | 6-158253 | A | | 6/1994 |
| JP | 7-268578 | A | | 10/1995 |
| JP | 9-41106 | A | | 2/1997 |
| JP | 9-316620 | A | | 12/1997 |
| JP | 09316620 | A | * | 12/1997 |
| JP | 2001-140050 | A | | 5/2001 |
| JP | 2001140050 | A | * | 5/2001 |
| JP | 2002-129298 | A | | 5/2002 |
| JP | 2002-322550 | A | | 11/2002 |

OTHER PUBLICATIONS

Translation of JP 09316620 (1997).*

Extended European Search Report issued on Jan. 24, 2011 for European Application No. 07744535.1.

* cited by examiner (a)

(b)

(a)

(b)

DEVICE FOR PREVENTING WINDING-UP OF SHEET METAL IN CONTINUOUS HOT-DIPPING BATH

TECHNICAL FIELD

The present invention relates to a system for prevention of stirred up dross provided with flow regulating members for suppressing stir up and deposition on the plating surface of bottom dross and other solid particles precipitated or floating in a plating bath in the continuous hot-dip plating process of steel sheet or other metal sheet.

BACKGROUND ART

Various types of hot dip plated metal sheet have been developed and commercialized up to now. Among these, hot dip galvanized steel sheet is spreading widely as a material for automobiles, buildings, the electric home appliances, etc. due to its superior corrosion resistance and economy.

The present invention may be applied to not only hot dip galvanization, but also aluminum plating, tin plating, and other various types of hot-dip plating bath, but the case of the most general hot dip galvanization system for steel sheet will be taken as an example and explained below.

When continuously producing hot dip galvanized steel sheet, the method of dipping and moving the steel sheet in a hot-dip plating bath to plate it has been generally used.

At this time, it is known that the solid particles of impurities precipitated and deposited at the bottom of the hot-dip plating bath, for example, bottom dross, are stirred up along with the movement of the steel sheet during the plating treatment and stick to the steel sheet plated surface to thereby detract from the appearance of the plated steel sheet.

Various measures are being tried out on the work site to deal with this stirred up bottom dross in hot-dip plating bath, but no complete solution has yet been found.

FIG. 9 shows the outlines of a generally used continuous hot dip galvanization system of steel sheet. In the continuous hot dip galvanization system shown in FIG. 9, after a steel sheet 1 is annealed by an annealing furnace (not shown), it passes through a snout 2 and enters a hot dip galvanization bath 3.

The introduced steel sheet is changed in direction to face upward by a sink roll 4 provided inside the hot dip galvanization bath 3, is corrected for warping by support rolls 5, then is pulled out from a plating bath surface 6.

Next, the two sides of the hot dip galvanized plated steel sheet 1' are blown with wiping gas from gas wiping nozzles 7 to adjust the amount of coating weight Furthermore, the plated steel sheet 1' is passed through a vibration dampening system 8 for correcting its shape and suppressing steel sheet vibration, and then treated to alloy the plating as needed in a galvannealing furnace 9.

Inside the hot dip galvanization bath, Fe elutes from the steel sheet into the hot dip galvanization bath whereby particulate and granular substances comprised of Fe—Zn intermetallic compounds, that is, so-called "dross", are produced.

In this dross, the part mainly comprised of $FeZn_7$ has a larger specific gravity than the molten zinc, so precipitates and deposits on the plating bath bottom. In general, this is called "bottom dross" (see 10 in FIG. 9).

Bottom dross starts to be stirred up due to the accompanying flow caused by movement of the steel sheet circling the sink roll in the galvanization bath and finally sticks to the surface of the plated steel sheet to cause poor appearance of the plated steel sheet.

In particular, the bottom dross is caught and pressed at the part where the sink roll or support roll and steel sheet contact each other and remains on the plated steel sheet thereby becoming a cause aggravating the poor appearance when press forming the plated steel sheet into the final product.

In particular, on recent work sites, attempts are being made to raise the processing rate of steel sheet to improve production capabilities. Along with this, in the plating bath, the agitation becomes stronger, and the amount of elution of Fe, the cause of formation of dross, increases, and the bottom dross is stirred up much more vigorously.

Further, on the other hand, customers are becoming tougher regarding the quality of appearance of the plated steel sheet they seek. There is therefore pressure on the work floor for solving the problem of stirred up bottom dross.

To solve this problem, various proposals have been made in the past.

For example, Japanese Patent Publication (B2) No. 6-21331 and Japanese Utility Model Publication (U) No. 5-38045 propose a method of suppressing stirred up bottom dross comprising providing a covering plate covering the entire cylinder length of the sink roll and suppressing flow in the plating bath between the sink roll and plating tank bottom and forming a space in which bottom dross deposits below this covering plate.

Further, Japanese Patent Publication (A) No. 6-158253 proposes a continuous hot dip galvanization system providing a multi-hole plate suppressing flow motion in the bath between the sink roll and plating tank bottom.

Furthermore, Japanese Patent Publication (A) No. 2001-140050 proposes a system for prevention of stirred up bottom dross characterized by providing two plate-shaped members of lengths corresponding to 20 to 40% of the sink roll cylinder length away from the sink roll surface from the two ends of the sink roll toward the center.

However, with these proposals, as explained later, it is difficult to completely solve the problem of stirred up bottom dross.

For stirred up bottom dross in hot dip galvanization baths, in the past it had mainly been considered that the tangential direction force caused along with rotation of the sink roll (see 11 in FIG. 9) caused the bottom dross deposited at the bottom near the sink roll to be stirred up.

However, the inventors worked to study the phenomenon of stirred up bottom dross by running 3D flow motion analysis on the inside of hot dip galvanization baths. As a result, they discovered that the flow accompanying the steel sheet becomes strong at the part narrowed by the sink roll.

That is, jet flow occurring at the sides of the contact part of the sink roll moves strongly toward the bottom of the sides in the hot dip galvanization bath, so the inventors discovered that the bottom dross deposited at the bottom of the hot dip galvanization bath was stirred up.

When the steel sheet is a broad width material, as shown in FIG. 10(*a*), the jet flow occurring at the sides of the contact part of the sink roll causes a force to act on the bottom dross stirring up the bottom dross from near the front center of the sink roll 4 (see A in the figure).

Further, when the steel sheet is a narrow width material, as shown in FIG. 10(*b*), a force acts on the bottom dross stirring up the bottom dross between the sink roll 4 and the side walls of the hot dip galvanization bath 3 (see B in the figure).

In each case, as a result, the bottom dross is stirred up inside the plating bath in a manner drawing a circle in the vertical direction and enters a floating state. The inventors elucidated the mechanism whereby the bottom dross enters a floating state and has a detrimental effect on plating of steel sheet.

Assuming this mechanism, the prior art has the following problems:

First, the method disclosed in Japanese Patent Publication (B2) No. 6-21331 and Japanese Utility Model Publication (U) No. 5-38045 can effectively prevent stirred up bottom dross by the provision of a covering plate for bottom dross trying to flow in a tangential direction of the circumference due to rotation of the sink roll, but no covering measure or flow regulating measure is taken against the wall surface flow occurring at the two side surfaces of the sink roll, so the stirred up bottom dross cannot be sufficiently suppressed.

Second, the apparatus disclosed in Japanese Patent Publication (A) No. 6-158253 does not provide any means for solving the problem of the wall surface flow occurring at the two side surfaces of the sink roll, so the effect of suppressing stirred up bottom dross is not sufficient.

Further, in the above apparatus, the multi-hole flow regulating plate is provided for substantially the entire sink roll in the width direction, so turbulence occurs between the sink roll and multi-hole flow regulating plate, bottom dross sticks to the surface of the steel sheet not contacting the sink roll, and bottom dross is liable to deposit on the multi-hole flow regulating plate.

Furthermore, in the above apparatus, there is the problem that at the time of replacement of the sink roll etc., the work of threading the steel sheet through the sink roll and rest of the plating apparatus becomes complicated.

Third, in the apparatus disclosed in Japanese Patent Publication (A) No. 2001-140050, two covering plates are set at the two sides of the sink roll in a state separated from each other, so the problem at the time of replacement of the sink roll etc. is solved, but no measure is taken for regulating the wall surface flow occurring at the two side surfaces of the sink roll, so stirred up bottom dross cannot be completely suppressed.

Further, in the above apparatus, when the distance between the sink roll and the plate members is large, the bottom dross deposits on the plate members, so when changing the steel sheet from a narrow width material to a broad width material, the stirring up of the deposited dross is aggravated.

Conversely, when the distance between the sink roll and plate members is small, a strong flow including bottom dross concentrates at this small distance, so the bottom dross is scattered throughout the plating bath and the bottom dross is liable to be caught between the sink roll or support roll and the steel sheet.

DISCLOSURE OF THE INVENTION

The present invention has as its object the provision of a system able to prevent impurities precipitated and deposited at the bottom of a hot dip galvanization bath, that is, bottom dross, in the process of continuous hot dip galvanization of steel sheet, from being stirred up and sticking on the plated surface of the steel sheet along with movement of the steel sheet during the plating treatment regardless of the width of the steel sheet.

The present invention was made to solve the above problem and has as its gist the following:

(1) A system for prevention of stirred up dross in continuous hot-dip plating bath of a metal sheet characterized by placing flow regulating members partially separated from each other under a sink roll at the two side wall surfaces of a hot-dip plating bath which axial ends of the sink roll face so that said members contact the wall surfaces and thereby suppressing the flow of hot dip metal ascending or descending along the wall surfaces.

(2) A system for prevention of stirred up dross in continuous hot-dip plating bath of a metal sheet characterized by placing flow regulating members at the two side wall surfaces of a hot-dip plating bath which axial ends of the sink roll face so that said members contact the wall surfaces and so that parts of said members are positioned at positions of a distance from the hot-dip plating bath bottom exceeding 0.8 time a distance between said bottom and a bottom end of the sink roll and thereby suppressing the flow of hot dip metal ascending or descending along the wall surfaces.

(3) A system for prevention of stirred up dross in continuous hot-dip plating bath of a metal sheet characterized by placing flow regulating members at a front wall surface and/or rear wall surface of a hot-dip plating bath so that said members contact said wall surfaces and thereby suppressing the flow of hot dip metal ascending or descending along the wall surfaces.

(4) A system for prevention of stirred up dross in continuous hot-dip plating bath of a metal sheet as set forth in (3) characterized by placing flow regulating members at the two side wall surfaces of said hot-dip plating bath so that said members contact said wall surfaces and thereby suppressing the flow of hot dip metal ascending or descending along the wall surfaces.

(5) A system for prevention of stirred up dross in continuous hot-dip plating bath of a metal sheet as set forth in any of the above (1) to (4) characterized in that a width dimension W of the flow regulating members placed at the side wall surfaces of said hot-dip plating bath is shorter than a distance X from said side wall surfaces to ends of the steel sheet and longer than a distance Z from said side wall surfaces to support members of the sink roll.

(6) A system for prevention of stirred up dross in continuous hot-dip plating bath of a metal sheet as set forth in any of the above (1) to (5) characterized in that a depth dimension L of a flow regulating member set at a side wall surface of said hot-dip plating bath is longer than 0.7 time the sink roll diameter and shorter than a depth dimension Y of the inside of the hot-dip plating bath.

(7) A system for prevention of stirred up dross in continuous hot-dip plating bath of a metal sheet as set forth in any of the above (1) to (6) characterized in that said flow regulating member is provided with a plurality of holes and the total of the areas of the holes is 10 to 70% of the total area of said flow regulating member.

(8) A system for prevention of stirred up dross in continuous hot-dip plating bath of a metal sheet as set forth in any of the above (1) to (7) characterized in that said flow regulating member is provided with a plurality of holes and has an average area per hole of $1.2\times10^4$ $mm^2$ or less.

According to the present invention, when performing the continuous hot dip galvanization treatment in the state of a high processing rate, it becomes possible to reliably suppress the stirring up of bottom dross precipitated and deposited in the plating bath more than in the past and thereby greatly reduce the sticking of bottom dross on the plated steel sheet.

Further, according to the present invention, when replacing the sink roll etc., the work of threading the steel sheet through the sink roll and rest of the plating system can be performed easier than in the past.

BEST MODE FOR CARRYING OUT THE INVENTION

Figure 2:
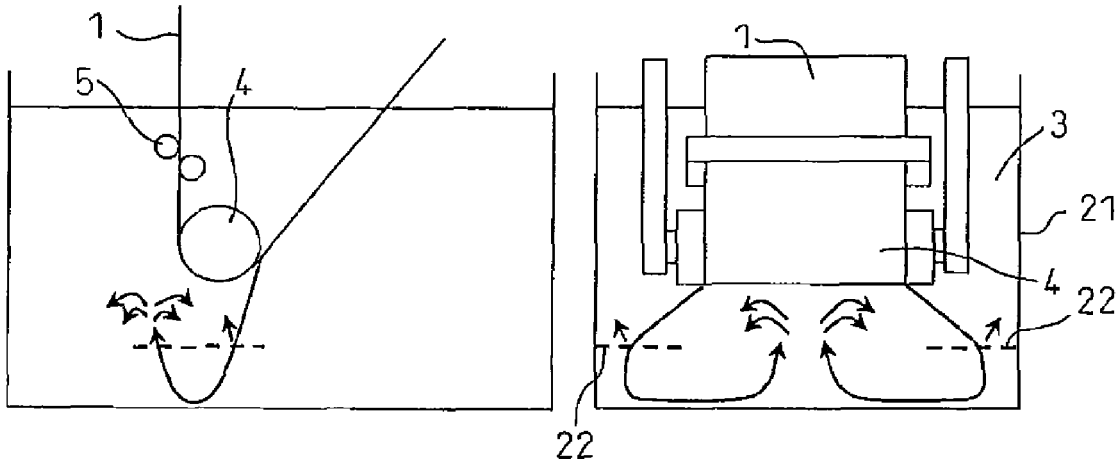
FIG. 2 is a view showing the modes of bath flow occurring in the first embodiment of the present invention. (a) shows the case of a broad width material, while (b) shows the case of a narrow width material.
Figure 2:
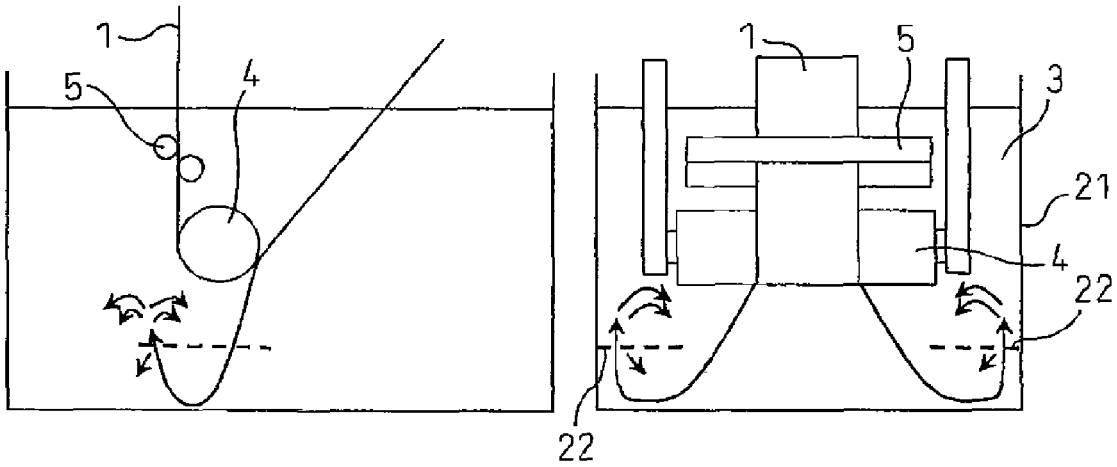

A first embodiment of the present invention will be explained first. The mode of bath flow in the case of using flow regulating members provided with a large number of holes, that is, "multi-hole flow regulating plates", is shown in FIG. 2.

Figure 10:
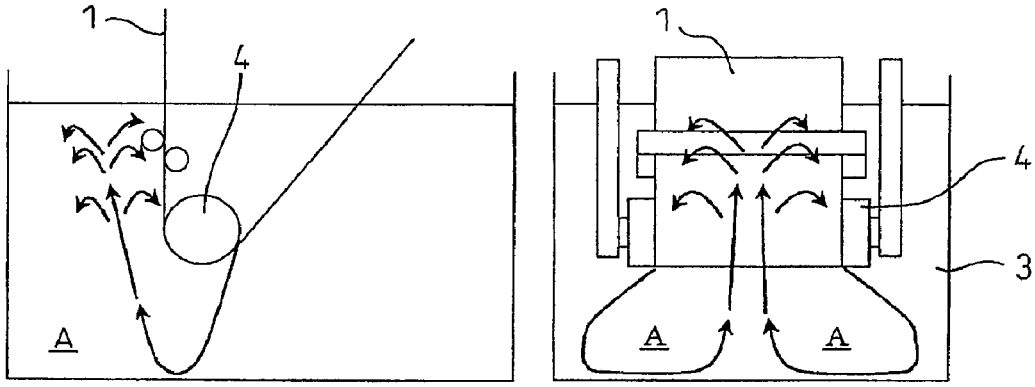
Fig. 10 Prior Art
FIG. 10 is a view showing the aspect of bath flow occurring in the system shown in FIG. 9. (a) shows the case of a broad width material, while (b) shows the case of a narrow width material.
Figure 10:
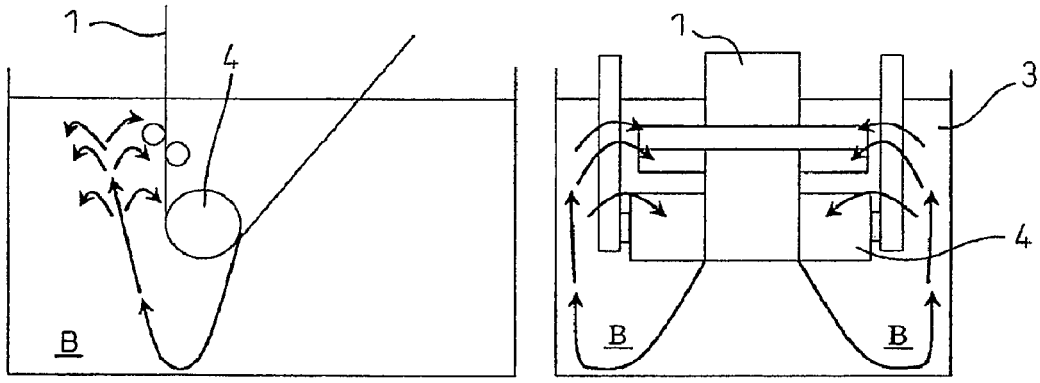
Fig. 10 Prior Art

When compared with FIG. 10 showing the state where no flow regulating members are provided, the direction of bath flow is almost unchanged, but due to the provision of the multi-hole flow regulating plates, an action and effect of reducing the flow rate at the wall surfaces are obtained. These action and effect enable the stirred up bottom dross to be kept in a low region of the hot dip galvanization bath.

Further, due to this action and effect, the amount of bottom dross being caught in the steel sheet can be reduced.

Note that the effect due to the provision of the multi-hole flow regulating plates is believed to be mainly effective against bottom dross being caught up at the support rolls in the case of a broad width material and to be mainly effective against bottom dross being caught up in the sink roll in the case of a narrow width material.

Figure 1:
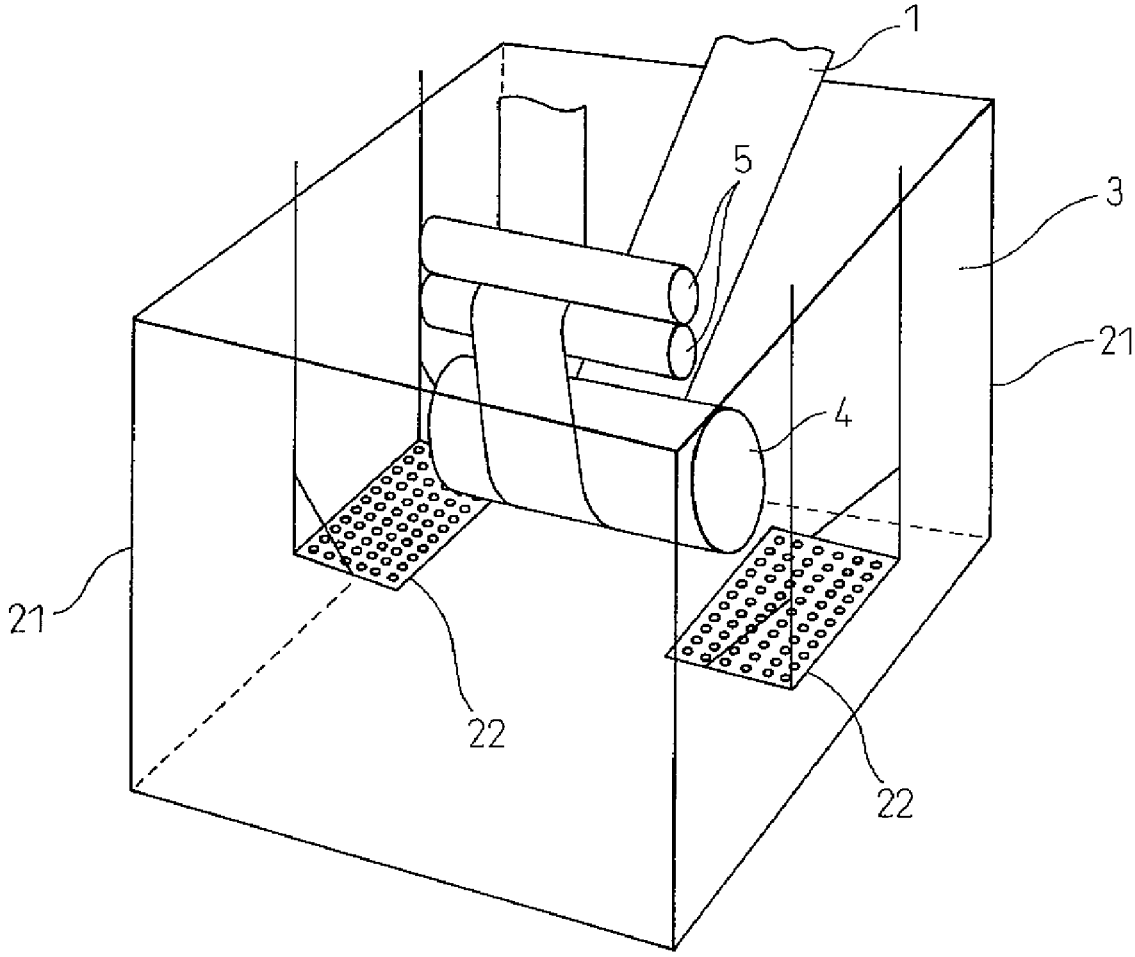
FIG. 1 is a view showing a first embodiment of the present invention.

In the present invention, the flow regulating members are provided in the plating bath, as shown in FIG. 1, so that the flow regulating members 22 contact the two side wall surfaces 21 in the plating bath 3.

The "contact" referred to in the present invention does not mean the state where the flow regulating members 22 are directly attached to the side wall surfaces 21 of the plating bath.

Figure 3:
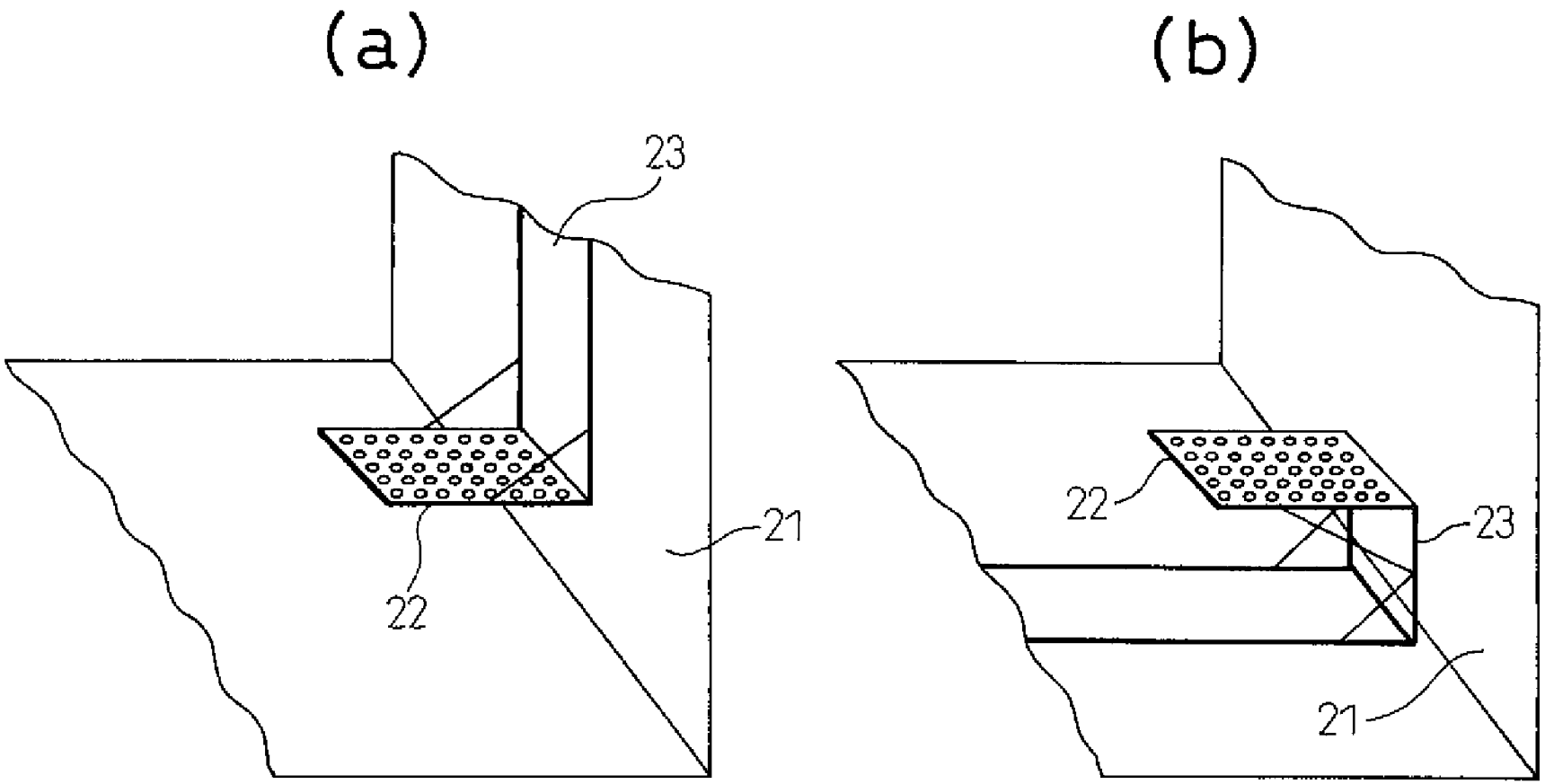
FIG. 3 shows the mode of placement of a multi-hole flow regulating plate. (a) shows a mode where the multi-hole flow regulating plate is suspended via a support member, while (b) shows the mode where the multi-hole flow regulating plate is propped up via a support member

The "contact", as shown in FIG. 3(*a*), also means the state of attaching a flow regulating member 22 to a support member 23 suspended from above and, further, as shown in FIG. 3(*b*), the state of attaching a flow regulating member 22 to a support member 23 propped up at the bottom of the plating bath and other cases where there is a slight clearance between the side wall surface 21 and flow regulating member 22.

For example, in actual operation, when stopping production and performing cleaning work to remove the bottom dross deposited in the plating bath, sometimes having the flow regulating members 22 fastened to the two side wall surfaces 21 would interfere with the cleaning work.

On the other hand, as shown in FIGS. 3(*a*) and (*b*), if suspending the flow regulating member 22 by support members 23 like pipe frames or propping up the flow regulating members 22 on support members 23, attachment/detachment of the flow regulating members 22 would become easy and cleaning work could be easily performed.

Even if the flow regulating members 22 do not completely contact the two side wall surfaces 21, in practice the effect of reducing the side wall surface flow can be expected. Note that as another method of attaching the flow regulating members 22, attachment to the support members of the sink roll to make integral members is also possible.

Further, in the present invention, the flow regulating members are provided in the plating bath so that, as shown in FIG. 1, at least parts of the flow regulating members 22 in the plating bath 3 are separated from each other under the sink roll.

That is, this means the state where there are no flow regulating members near the center of the sink roll and the space is open, in other words, the members of the pair or pairs of flow regulating members contacting the two side wall surfaces are arranged separated from each other across a distance.

The reason for this is that if placing the flow regulating members along the entire cylinder length of the sink roll, the dross floating near the center of the sink roll is liable to precipitate and deposit on the flow regulating members and later be stirred up.

Near the center of the sink roll, the flow of the molten metal is slower than near the two ends, so even if there are no flow regulating members there, there is little risk of the bottom dross being stirred up.

Further, if flow regulating members are provided extending across the bottom of the sink roll near its center, the work of attaching the front end of the steel sheet to the sink roll when starting the plating operation, the so-called "threading" work, will become complicated.

Second and third embodiments of the present invention will be explained based on FIG. 4 and FIG. 5.

Figure 4:
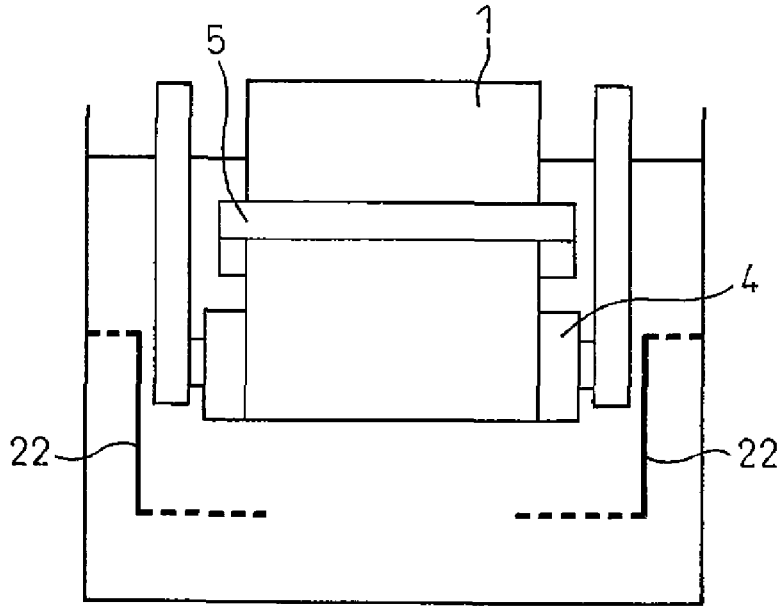
FIG. 4 is a view showing a second embodiment of the present invention.
Figure 5:
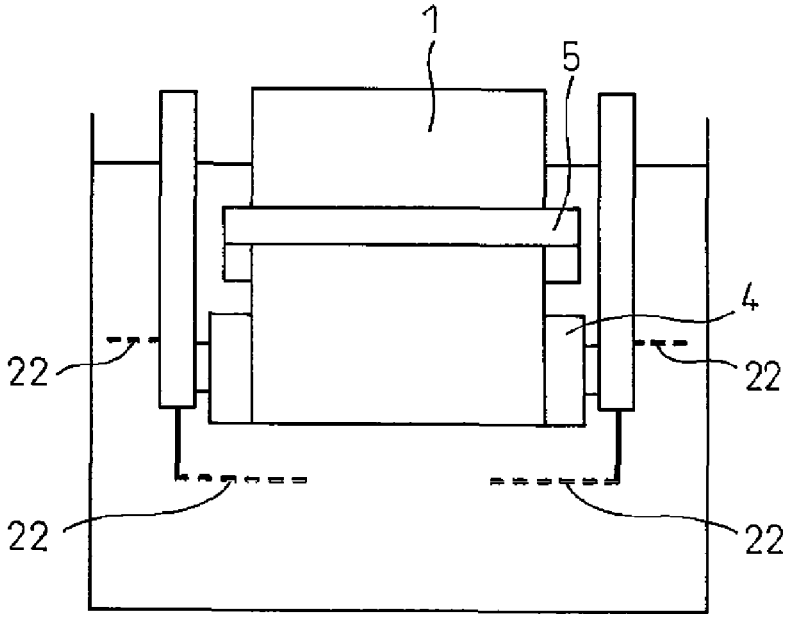
FIG. 5 is a view showing a third embodiment of the present invention.

FIG. 4 and FIG. 5 are views showing modes of placement of flow regulating members at the two side wall surfaces of a hot-dip plating bath which the axial ends of the sink roll face so that parts of the flow regulating members are positioned at locations of a distance from the bottom of the hot-dip plating bath of over 0.8 time the distance between said bottom and the bottom end of the sink roll.

FIG. 4 shows a mode of placing flow regulating members with step differences so that the parts contacting the side wall surfaces are positioned higher than the bottom end of the sink roll.

In the present invention, the flow regulating members are preferably provided at positions lower than the bottom end of the sink roll, more preferably positions 0.8 times or less the distance to the bottom end.

However, as shown in FIG. 4, even if parts of the flow regulating members are provided at positions over 0.8 times the distance, the ascending flow along the wall surfaces can be effectively suppressed.

The embodiment shown in FIG. 5 is also based on an idea similar to the embodiment shown in FIG. 4, but differs in the point that the flow regulating members are arranged at the support members of the sink roll.

As explained above, the flow regulating members of the present invention are designed to capture the ascending flow or descending flow along the wall surfaces and keep down the flow rate, so the heights of the flow regulating members do not have to be single heights. The flow regulating members of the present invention function to capture and regulate the ascending flow and descending flow at different height positions.

The fourth and fifth embodiments of the present invention will be explained based on FIG. 6 and FIG. 7.

Figure 6:
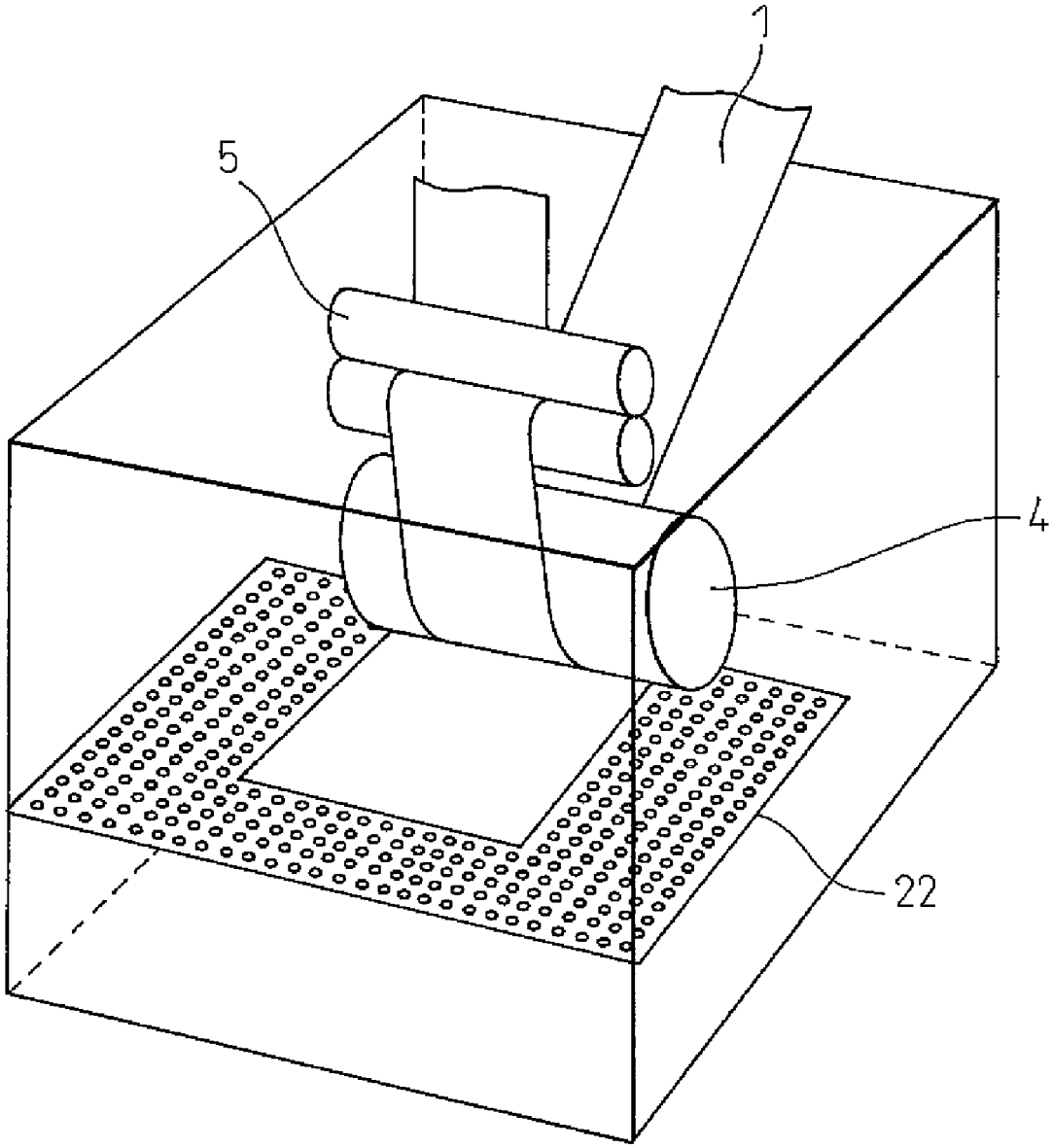
FIG. 6 is a view showing a fourth embodiment of the present invention.
Figure 7:
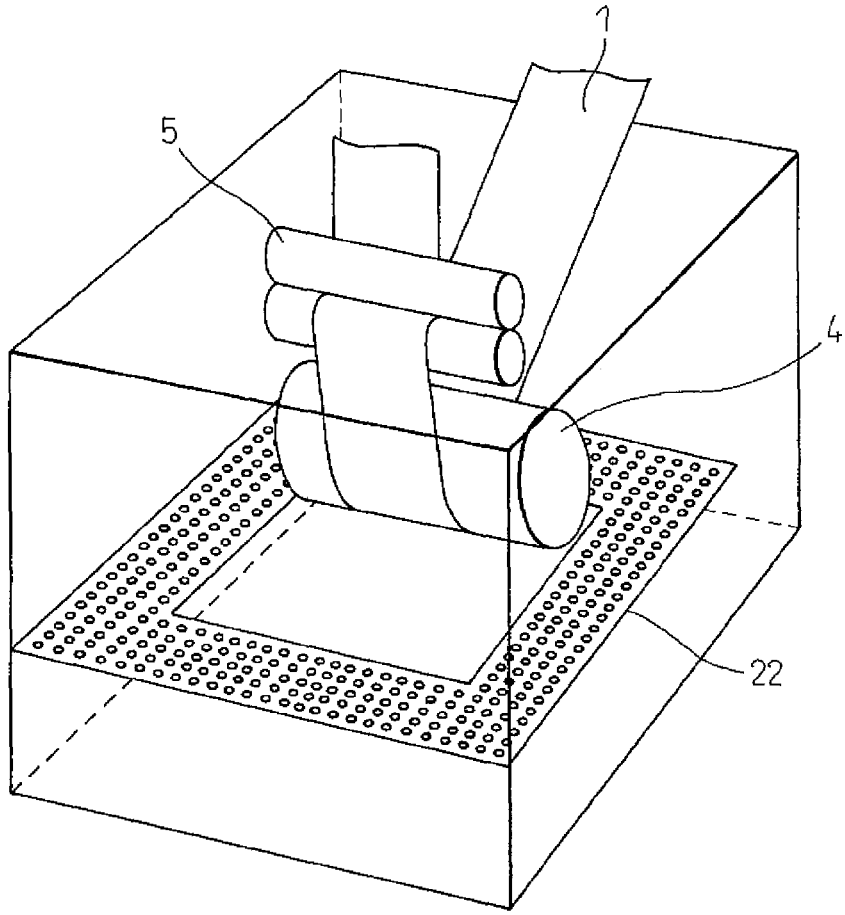
FIG. 7 is a view showing a fifth embodiment of the present invention.

FIG. 6 and FIG. 7 are views showing the state of placing flow regulating members in the hot-dip plating bath at the front wall surface and/or rear wall surface in addition to the side wall surfaces.

If the speed of movement of the steel sheet and the speed of rotation of the sink roll rise, a flow of hot dip metal will occur at both the front (exit side region of steel sheet) and rear (entry side region of steel sheet) of the hot-dip plating bath and may stir up the bottom dross.

Further, along with suppressing the flow at the side parts by the flow regulating members, the blocked flow of hot dip metal has nowhere to go and is liable to collect at the front or rear forming new stirring up loops.

These embodiments place flow regulating members at least at the front wall surface and/or rear wall surface and aim at suppressing the flow of molten metal from numerous directions.

The flow regulating members used in the present invention are not limited to the above multi-hole flow regulating plates. Various forms of members may be used.

For example, block-shaped members, wadding-shaped members, net-shaped members, members comprised of cages in which pellets are filled, and other members having the effect of reducing the wall surface flow rate may be freely used.

Further, the flow regulating members of the present invention do not necessarily have to be placed horizontally or flat. To prevent bottom dross from depositing on the flow regulating members, they may be placed at a slant or the members may be placed after bending them in advance.

By providing a large number of holes in the flow regulating members, it becomes possible to reduce the flow rate at the wall surfaces and still allow the passage of particle-shaped bottom dross. As a result, the amount of bottom dross depositing on the flow regulating members is reduced, so it is possible to reduce newly stirred up bottom dross.

On the other hand, in the case of hole-less flow regulating members, there is no such passage effect, but these are superior over flow regulating members provided with holes in the point of blocking the wall surface flow.

Note that the flow regulating members may be suitably provided with holes in accordance with need. The flow regulating members of the present invention are not limited to ones with or without holes.

However, when providing holes in the flow regulating members, the total area of the holes is preferably made 10 to 70% (aperture rate) of the total area of the flow regulating members and the average area per hole is preferably not more than $1.2\times10^4$ mm$^2$.

The aperture rate is more preferably 30 to 60%. If using flow regulating members with an aperture rate of 30 to 60%, a remarkable effect of keeping bottom dross from being stirred up can be obtained.

Flow regulating members with an aperture rate of less than 10% are poor in the ability to pass bottom dross and are susceptible to bottom dross depositing on the flow regulating members. In particular, deposition of bottom dross is aggravated when processing broad width materials.

On the other hand, flow regulating members with an aperture rate exceeding 70% are inferior in ability to reduce the wall surface flow rate and cannot effectively suppress stirred up bottom dross.

Further, if the average area per hole exceeds $1.2\times10^4$ mm$^2$, it becomes difficult to uniformly reduce the wall surface flow rate, so this is not preferred.

Note that the lower limit of the average area per hole is not particularly set, but the size of the bottom dross is usually on the μm order to several mm or so, so the area of the holes should be any area of an extent enabling easy passage of the bottom dross, for example, 10 mm$^2$ or more.

The shape of the holes is also not particularly limited. Members provided with regular circular holes like punched metal, members made of metal mesh, etc. may be suitably selected as flow regulating members.

The dimensions of the flow regulating members of the present invention should be dimensions enabling effective regulation of the ascending flow or descending flow along the wall surfaces and are suitably determined in accordance with the dimensions of the hot-dip plating bath facility used.

The method of determining the dimensions of the flow regulating members placed at the side wall surfaces will be explained with reference to FIG. 8.

The width dimension W of the flow regulating members is set shorter than the distance X from the side wall surfaces to the ends of the steel sheet and longer than the distance Z from the side wall surfaces to the sink roll support members.

When $W \geqq X$, the amount of bottom dross depositing on the flow regulating members increases and the frequency of dross sticking to the steel sheet (bottom dross sticking rate) rises. Further, at the time of replacing the sink roll, the work of threading the steel sheet is liable to be obstructed. On the other hand, when $W \leqq Z$, a sufficient flow regulating effect sometimes cannot be obtained.

Therefore, the width dimension W of the flow regulating member preferably satisfies $Z<W<X$.

Note that the steel sheet when finding the distance X is made the steel sheet with the narrowest width in the steel sheets treated.

The depth dimension L of the flow regulating members is preferably set longer than 0.7 time the diameter D of the sink roll and shorter than the depth dimension Y of the inside of the plating bath.

When $L \leqq 0.7D$, the side jet flow occurring from the contact part of the sink roll cannot be covered and a sufficient flow regulating effect cannot be obtained in some cases. On the other hand, when $L \geqq Y$, it is physically impossible for the plating bath to house the flow regulating plates.

Therefore, the depth dimension L of the flow regulating members preferably satisfies $0.7D<L<Y$.

Note that regarding the placement positions of the flow regulating members in the front-rear direction, it is particularly preferable that the centers of the flow regulating members be placed at positions offset to the front side (steel sheet exit side) rather than being right below the sink roll.

In the present invention where the flow regulating members are placed in the above-mentioned way, as shown in FIGS. 2(*a*) and (*b*), both when the steel sheet being treated is a broad width material and a narrow width material, the flow regulating members can reduce the flow rate of the wall surface flow and as a result stirred up bottom dross can be remarkably prevented.

EXAMPLES

Below, the present invention will be explained based on the examples.

Flow regulating members of the following conditions were placed inside a continuous hot dip galvanization bath, steel sheets were treated by continuous hot dip galvanization, and the bottom dross sticking rates on the plated steel sheets due to stirred up bottom dross were measured. The results are shown in Table 1.

[Specifications of Flow Regulating Members]

Shape and material: 12 mm thick austenite-based stainless steel sheets

Presence of holes: Treatment performed under two conditions of "multi-hole" and "hole-less" members. In the case of multi-hole members, the aperture rate was 50% and the average area per hole was $7.9\times10^3$ $mm^2$.

Placement conditions: Members placed at heights of 600 mm from bottom end of sink roll and 600 mm from bottom of plating bath.

[Test Conditions]

Plating bath: Molten zinc

Processing rate: 150 m/min

Test coils: Cold-rolled ordinary carbon steel coils of sheet thickness of 0.6 to 0.7 mm×sheet width of 1,500 to 1,690 mm (narrow width materials)

Cold-rolled ordinary carbon steel coils of sheet thickness of 0.6 to 0.7 mm×sheet width of 1,700 to 1,820 mm (broad width materials)

For each of the different condition multi-hole flow regulating plates, about 40 test coils were plated on a hot dip galvanization line and the following formula was used to find the bottom dross sticking rate of the steel sheets. The presence of sticking of bottom dross was judged by visual inspection.

Bottom dross sticking rate(%)=(Number of coils with sticking of bottom dross/Number of tested coils)×100

Passing or failing of sticking of bottom dross was judged by the following criteria based on the average rates of the bottom dross sticking rates for the narrow width materials and broad width materials:

Passing (Very Good): Less than 6%

Passing (Good): 6% to less than 8%

Passing (Fair): 8% to less than 12%

Failing: 12% or more

TABLE 1

| No. | Flow regulating members | Placement conditions of flow regulating members | Dross sticking rate of steel sheet: Narrow width material (%) | Dross sticking rate of steel sheet: Broad width material (%) | Judgment | Remarks |
|---|---|---|---|---|---|---|
| 1 | Multi-hole flow regulating plates | Contact, separated by 1600 mm, side wall surfaces | 6 | 7 | Good | Invention, 1st embodiment |
| 2 | Hole-less flow regulating plates | Contact, separated by 1600 mm, side wall surfaces | 7 | 14 | Fair | Invention, 1st embodiment |
| 3 | Multi-hole flow regulating plates | Non-contact, separated by 1600 mm, side wall surfaces | 13 | 12 | Fail | Comp. ex. |
| 4 | Multi-hole flow regulating plates | Contact, not separated | 12 | 12 | Fail | Comp. ex. |
| 5 | Multi-hole flow regulating plates | Non-contact, not separated | 13 | 13 | Fail | Comp. ex. |
| 6 | No flow regulating members | — | 13 | 15 | Fail | Comp. ex. |
| 7 | Multi-hole flow regulating plates | Contact, separated by 1600 mm, side and front wall surfaces | 6 | 8 | Good | Invention, 4th embodiment |
| 8 | Multi-hole flow regulating plates | Contact, separated by 1000 mm, side, front, and rear wall surfaces | 5 | 6 | Very good | Invention, 5th embodiment |
| 9 | Multi-hole flow regulating plates | Non-contact, separated by 800 mm, side and front wall surfaces | 13 | 13 | Fail | Comp. ex. |

Flow regulating members placed at side wall surfaces under two conditions of "contact" and "non-contact". "Contact" indicates state where ends of flow regulating members contact wall surfaces, while "non-contact" indicates state where they do not contact wall surfaces.

Flow regulating members placed at side wall surfaces under conditions of "separated" and "not separated".

For example, "separated by 1600 mm" indicates the state where a pair of flow regulating members placed at the two side wall surfaces are placed separated by a distance of 1600 mm under the sink roll. "Not separated" indicates the state where the flow regulating members are connected together with being separated by any distance.

No. 1 and No. 2 of Table 1 show the case where the ends of the flow regulating plates are made to contact the side wall surfaces and the flow regulating plates are placed separated from each other below the sink roll and correspond to the first embodiment of the present invention.

The bottom dross sticking rates of steel sheets of both were in the passing range defined by the present invention, but No. 2 used flow regulating plates with no holes, so at the time of treatment of broad width materials, stirred up bottom dross was seen, so the results were inferior to those of No. 1.

No. 3, No. 4, No. 5, and No. 9 are cases where the placement conditions of the flow regulating members are non-contact or non-separation. In each case, stirred up bottom dross could not be sufficiently suppressed.

No. 6 is the case where no flow regulating members are placed and gave the worst results. No. 7 is the case where multi-hole flow regulating plates are placed and the side and front wall surfaces, while No. 8 is the case where the multi-hole flow regulating plates are placed at the side, front, and rear wall surfaces. These respectively correspond to the fourth embodiment shown in FIG. 6 and the fifth embodiment shown in FIG. 7

In this way, it could be confirmed that the effect of the present invention can be sufficiently obtained even when placing flow regulating members at other than the side wall surfaces as well.

Table 2 shows the results of tests conducted under the conditions of the second embodiment of the present invention shown in FIG. 4 or the third embodiment of the present invention shown in FIG. 5. For the flow regulating members, flow regulating plates with step differences were used.

The height of the high parts of the flow regulating plates is defined as the "Placement height 1", while the height of the low parts is defined as the "Placement height 2". These are expressed as heights of a ratio with respect to the distance from the bottom of the hot-dip plating bath to the bottom end of the sink roll.

[Specifications of Flow Regulating Members]

Shape and material: 8 mm thick austenite-based stainless steel sheets

Presence of holes: Multi-hole flow regulating plates with aperture rate of 50% and average area per hole of $2.0\times10^3$ $mm^2$ used.

Placement conditions: Flow regulating plates partially separated from each other under the sink roll were placed at the two side wall surfaces of a hot-dip plating bath so that the said flow regulating plates contacted the wall surfaces.

The test conditions etc. were similar to those of the above.

No. 10 to No. 15 of Table 2 are examples of making the "Placement height 2" a fixed value (0.5) and investigating the effects of the "Placement height 1". No. 10 to No. 13 where the "Placement height 1" exceeds 0.8 are in the passing range defined in the present invention.

As opposed to this, No. 14 and No. 15 where the "Placement height 1" is 0.8 or less tended to be inferior in the bottom dross sticking rate of steel sheet in both narrow width materials and broad width materials.

No. 16 to No. 21 of Table 2 are examples of making the "Placement height 1" a fixed value (1.0) and investigating the effects of the "Placement height 2". It was learned that good results are obtained in the range of a "Placement height 2" of 0.3 to 0.7.

No. 22 is the case of the third embodiment and shows that it is in the passing range defined in the present invention.

The dimensions of the flow regulating members placed at the side wall surfaces were tested. The results are shown in Table 3.

[Specifications of Flow Regulating Members]

Shape and material: 12 mm thick austenite-based stainless steel sheet

Presence of holes: Multi-hole flow regulating plates with aperture rate of 50% and average area per hole of $2.0\times10^3$ $mm^2$ used.

Placement conditions: Placed 600 mm from bottom end of sink roll and 600 mm from bottom of plating bath.

Flow regulating members partially separated from each other under the sink roll placed at two side wall surfaces of hot-dip plating bath so that said members are in state contacting wall surfaces.

The other test conditions etc. are similar to the case of Table 1.

TABLE 2

| | Placement conditions of flow regulating members with step differences | | Dross sticking rate of steel sheet | | | |
|---|---|---|---|---|---|---|
| No. | Placement height 1 | Placement height 2 | Narrow width material (%) | Broad width material (%) | Judgment | Remarks |
| 10 | 0.9 | 0.5 | 6 | 7 | Good | Invention, 2nd embodiment |
| 11 | 1.0 | 0.5 | 7 | 8 | Good | Invention, 2nd embodiment |
| 12 | 1.1 | 0.5 | 6 | 5 | Very good | Invention, 2nd embodiment |
| 13 | 1.2 | 0.5 | 6 | 8 | Good | Invention, 2nd embodiment |
| 14 | 0.8 | 0.5 | 12 | 12 | Fail | Comp. ex. |
| 15 | 0.7 | 0.5 | 12 | 13 | Fail | Comp. ex |
| 16 | 1.0 | 0.2 | 12 | 11 | Fair | Invention, 2nd embodiment |
| 17 | 1.0 | 0.3 | 6 | 6 | Good | Invention, 2nd embodiment |
| 18 | 1.0 | 0.6 | 6 | 6 | Good | Invention, 2nd embodiment |
| 19 | 1.0 | 0.7 | 7 | 7 | Good | Invention, 2nd embodiment |
| 20 | 1.0 | 0.8 | 10 | 8 | Fair | Invention, 2nd embodiment |
| 21 | 1.0 | 0.9 | 11 | 8 | Fair | Invention, 2nd embodiment |
| 22 | 1.2 | 0.5 | 8 | 8 | Fair | Invention, 3rd embodiment |

(Notes)

"Placement height" is distance from bottom of hot-dip plating bath to flow regulating members expressed as a ratio with respect to distance between bottom and bottom end of sink roll. "Placement height 1" corresponds to height of high parts in flow members with step differences, while "Placement height 2" corresponds to height of low parts.

TABLE 3

| No. | Z (mm) | W (mm) | X (mm) | 0.7D (mm) | L (mm) | Y (mm) | Dross sticking rate ofsteel sheet: Narrow width material (%) | Broad width material (%) | Judgment | Remarks |
|---|---|---|---|---|---|---|---|---|---|---|
| 23 | 350 | 330 | 900 | 560 | 1000 | 4000 | 12 | 11 | Fair | Inv. ex. |
| 24 | 350 | 340 | 900 | 560 | 1000 | 4000 | 12 | 10 | Fair | Inv. ex. |
| 25 | 350 | 350 | 900 | 560 | 1000 | 4000 | 11 | 11 | Fair | Inv. ex. |
| 26 | 350 | 380 | 900 | 560 | 1000 | 4000 | 7 | 7 | Good | Inv. ex. |
| 27 | 350 | 500 | 900 | 560 | 1000 | 4000 | 8 | 6 | Good | Inv. ex. |
| 28 | 350 | 600 | 900 | 560 | 1000 | 4000 | 7 | 7 | Good | Inv. ex. |
| 29 | 350 | 800 | 900 | 560 | 1000 | 4000 | 6 | 5 | Very good | Inv. ex. |
| 30 | 350 | 1000 | 1200 | 560 | 1000 | 4000 | 7 | 6 | Good | Inv. ex. |
| 31 | 350 | 1300 | 1200 | 560 | 1000 | 4000 | 9 | 11 | Fair | Inv. ex. |
| 32 | 350 | 1400 | 1200 | 560 | 1000 | 4000 | 8 | 11 | Fair | Inv. ex. |
| 33 | 350 | 1100 | 1200 | 560 | 500 | 4000 | 11 | 12 | Fair | Inv. ex. |
| 34 | 350 | 1100 | 1200 | 560 | 550 | 4000 | 11 | 10 | Fair | Inv. ex. |
| 35 | 350 | 1100 | 1200 | 560 | 560 | 4000 | 10 | 12 | Fair | Inv. ex. |
| 36 | 350 | 1100 | 1200 | 560 | 580 | 4000 | 7 | 8 | Good | Inv. ex. |
| 37 | 350 | 1100 | 1200 | 560 | 800 | 4000 | 5 | 8 | Good | Inv. ex. |
| 38 | 350 | 1100 | 1200 | 560 | 1200 | 4000 | 7 | 6 | Good | Inv. ex. |
| 39 | 350 | 1100 | 1200 | 560 | 1800 | 4000 | 5 | 3 | Very good | Inv. ex. |
| 40 | 350 | 1100 | 1200 | 560 | 2400 | 4000 | 4 | 2 | Very good | Inv. ex. |
| 41 | 350 | 1100 | 1200 | 560 | 2600 | 4000 | 4 | 5 | Very good | Inv. ex. |
| 42 | 350 | 1100 | 1200 | 560 | 3500 | 4000 | 6 | 6 | Good | Inv. ex. |

Figure 8:
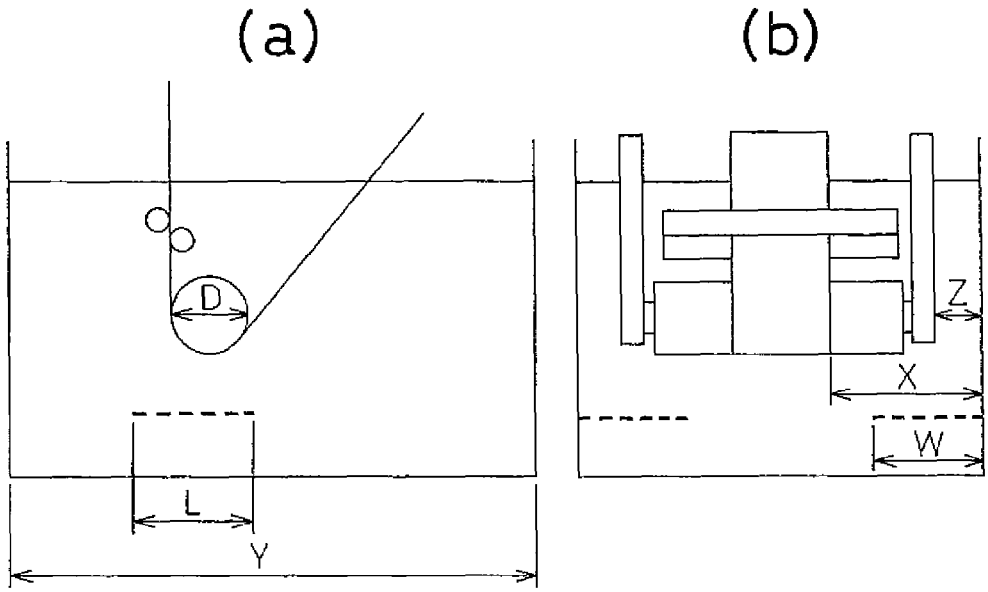
FIG. 8 is a view for explaining the method of determination of the dimensions of a flow regulating member placed at the side wall surface. (a) shows a side view of a continuous hot dip galvanization system, while (b) shows a front view.
Figure 9:
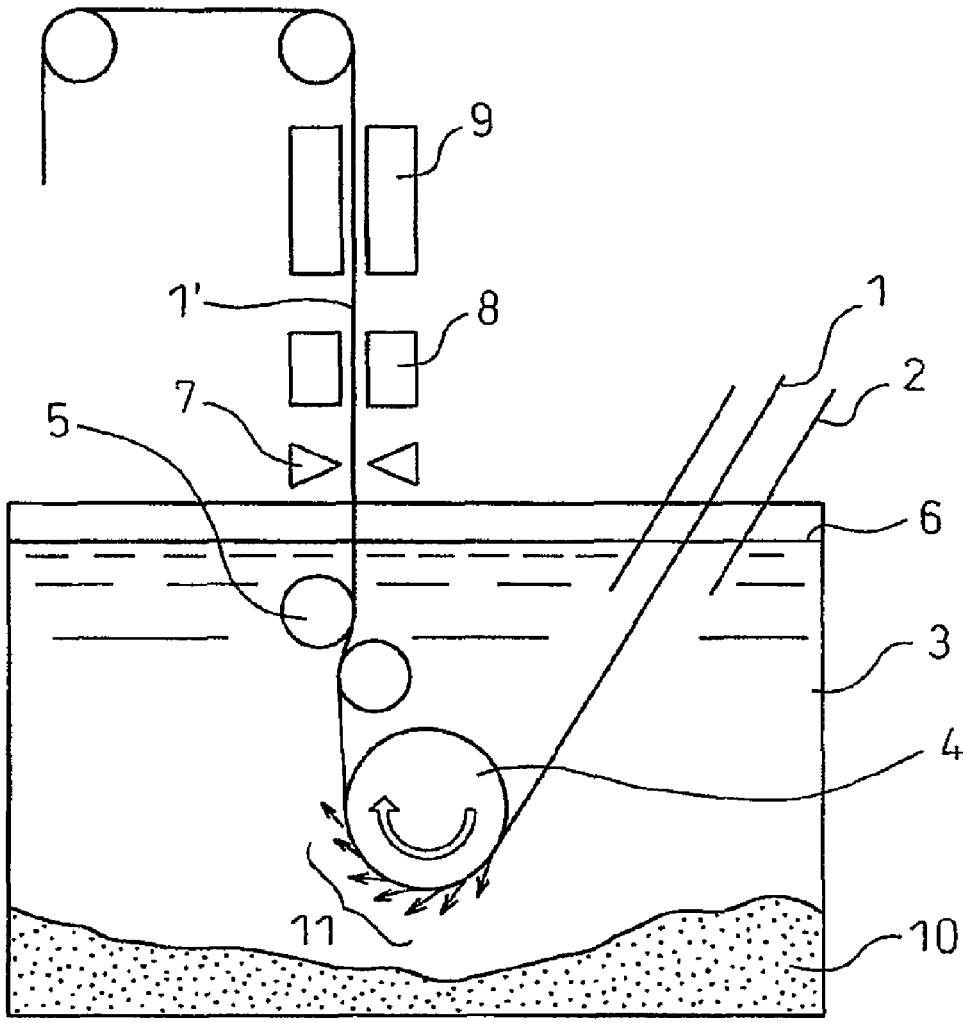
Fig.9 Prior Art
FIG. 9 is a view showing an outline of a general continuous hot dip galvanization system.

The symbols Z, W, X, D, L, and Y in Table 3 correspond to those shown in FIG. 8. No. 23 to No. 32 of Table 3 show cases setting the depth dimension L of the flow regulating members to a certain value (1000 mm) and investigating mainly the effects of changes in the width dimension W of the flow regulating members.

When W is a length of not more than the distance Z from the side wall surfaces to the sink roll support members, the bottom dross sticking rate of the steel sheet tends to become poor (No. 23, No. 24, and No. 25). This is believed to be because the flow regulating plates cannot sufficient trap the ascending or descending wall surface flows and the bottom dross is stirred up.

On the other hand, when W is a length of more than the distance X from the side wall surfaces to the ends of the steel sheet, the bottom dross sticking rate of the steel sheet tends to become poor for broad width materials (No. 31 and No. 32). This is believed to be due to the increase in the amount of bottom dross depositing on the flow regulating members and the higher frequency of dross sticking to the steel sheet.

On the other hand, No. 33 to No. 42 of Table 3 are cases setting W to a fixed value (1100 mm) and investigating the effects of change of L. When L is a length of less than 0.7 time the diameter D of the sink roll, the bottom dross sticking rate of the steel sheet tends to become poor (No. 33, No. 34, and No. 35).

This is believed to be due to the fact that the side jet flow occurring from the contact part of the sink roll cannot be covered and a sufficient flow regulating effect cannot be obtained.

Table 4 shows the results of tests performed using multi-hole flow regulating plates with different aperture rates and hole sizes.

[Specifications of Flow Regulating Members]

Shape and material: Austenite-based stainless steel sheets of depth 800 mm×width 600 mm×thickness 12 mm Placement conditions: The members were tested placed at heights of 600 mm from the bottom end of the sink roll and 600 mm from the bottom of the plating bath at the left and right wall surfaces of the plating bath so that the ends of the multi-hole flow regulating plates contacted the wall surfaces of the plating bath.

The other test conditions etc. are similar to the case of Table 1.

TABLE 4

| No. | Type of flow regulating members | Aperture rate (%) | Average area per hole ($\times 10^3$ mm$^2$) | Dross sticking rate of steel sheet: Narrow width material (%) | Broad width material (%) | Judgment | Remarks |
|---|---|---|---|---|---|---|---|
| 43 | Multi-hole flow regulating plates | 8 | 2.0 | 7 | 9 | Fair | Inv. ex. |
| 44 | Multi-hole flow regulating plates | 10 | 2.0 | 7 | 8 | Good | Inv. ex. |
| 45 | Multi-hole flow regulating plates | 20 | 2.0 | 6 | 7 | Good | Inv. ex. |
| 46 | Multi-hole flow regulating plates | 30 | 2.0 | 5 | 5 | Very good | Inv. ex. |
| 47 | Multi-hole flow regulating plates | 50 | 2.0 | 5 | 4 | Very good | Inv. ex. |
| 48 | Multi-hole flow regulating plates | 60 | 2.0 | 5 | 4 | Very good | Inv. ex. |
| 49 | Multi-hole flow regulating plates | 70 | 2.0 | 7 | 8 | Good | Inv. ex. |
| 50 | Multi-hole flow regulating plates | 75 | 2.0 | 9 | 9 | Fair | Inv. ex. |
| 51 | Holeless flow regulating plates | 0 | 0.0 | 7 | 14 | Fair | Inv. ex. |
| 52 | Multi-hole flow regulating plates | 50 | 7.9 | 7 | 7 | Good | Inv. ex. |
| 53 | Multi-hole flow regulating plates | 50 | 11.3 | 7 | 7 | Good | Inv. ex. |
| 54 | Multi-hole flow regulating plates | 50 | 13.3 | 8 | 9 | Fair | Inv. ex. |
| 55 | Multi-hole flow regulating plates | 50 | 15.4 | 9 | 9 | Fair | Inv. ex. |

TABLE 4-continued

| No. | Type of flow regulating members | Aperture rate (%) | Average area per hole ($\times 10^3$ mm$^2$) | Dross sticking rate of steel sheet: Narrow width material (%) | Dross sticking rate of steel sheet: Broad width material (%) | Judgment | Remarks |
|---|---|---|---|---|---|---|---|
| 56 | Multi-hole flow regulating plates | 50 | 0.1 | 6 | 7 | Good | Inv. ex. |
| 57 | Stacked wire mesh | 23 | 0.5 | 9 | 9 | Fair | Inv. ex. |
| 58 | No flow regulating members | — | — | 13 | 15 | Fail | Comp. ex. |

No. 43 to No. 50 of Table 4 are examples of making the size of the holes a fixed value ($2.0\times10^3$ mm$^2$) and investigating the effects of change of the aperture rate. As shown in No. 43, it is learned that if the aperture rate is less than 10%, the bottom dross sticking rate of steel sheet sometimes becomes poor.

This is believed to be due to the poor passing ability of the bottom dross and the ease of the bottom dross depositing on the flow regulating members.

Even in No. 51 of the flow regulating plates with no holes, for similar reasons, the result of the bottom dross sticking rate of steel sheet was poor. In contrast to this, No. 50 exhibited a high aperture rate of 75%.

The reason why the bottom dross sticking rate of steel sheet is poor is believed to be the poor ability to reduce the speed of the wall surface flow and the inability to effectively keep the bottom dross from being stirred up.

No. 52 to No. 56 are examples of making the aperture rate a certain value (50%), changing the average area per hole, and investigating the effects. If the average area per hole exceeds $12\times10^3$ mm$^2$, the bottom dross sticking rate of the steel sheet tends to become higher.

This is believed to be because the wall surface flow rate cannot be uniformly reduced and therefore bottom dross cannot be sufficiently kept from being stirred up.

No. 57 is an example of the case of use of stacked metal mesh instead of multi-hole flow regulating plates. It was learned that the advantageous effects of the present invention can be obtained in the same way as the case of multi-hole flow regulating plates.

As explained above, by placing flow regulating members according to the present invention in a hot dip galvanization bath, it is possible to keep the bottom dross from being stirred up and to reduce the rate of sticking of bottom dross on the plated steel sheet due to its being stirred up.

INDUSTRIAL APPLICABILITY

As explained above, according to the present invention, when performing continuous hot dip galvanization treatment in the state with a high processing rate, it becomes possible to keep bottom dross precipitated and deposited inside the plating bath from being stirred up more reliably than the past and thereby greatly reduce the sticking of bottom dross to the plated steel sheet.

Further, according to the present invention, it becomes possible to perform the work of threading the steel sheet through the sink roll and the rest of the plating apparatus at time of replacement of the sink roll etc. more easily than the past. Therefore, the present invention has high applicability in the plating industry.

The invention claimed is:

1. A system for prevention of stirred up dross in continuous hot-dip plating bath of a metal sheet characterized by placing flow regulating members partially separated from each other under a sink roll at the two side wall surfaces of a hot-dip plating bath which axial ends of the sink roll face so that said members contact the wall surfaces and thereby suppressing the flow of hot dip metal ascending or descending along the wall surfaces, wherein said flow regulating members are each provided with a plurality of holes.

2. A system for prevention of stirred up dross in continuous hot-dip plating bath of a metal sheet characterized by placing flow regulating members at the two side wall surfaces of a hot-dip plating bath which axial ends of the sink roll face so that said members contact the wall surfaces and so that parts of said members are positioned at positions of a distance from the hot-dip plating bath bottom exceeding 0.8 time a distance between said bottom and a bottom end of the sink roll and thereby suppressing the flow of hot dip metal ascending or descending along the wall surfaces, wherein said flow regulating members are each provided with a plurality of holes.

3. A system for prevention of stirred up dross in continuous hot-dip plating bath of a metal sheet characterized by placing flow regulating members at a front wall surface and/or rear wall surface of a hot-dip plating bath so that said members contact said wall surfaces and thereby suppressing the flow of hot dip metal ascending or descending along the wall surfaces, wherein said flow regulating members are each provided with a plurality of holes.

4. A system for prevention of stirred up dross in continuous hot-dip plating bath of a metal sheet as set forth in claim 3 characterized by placing flow regulating members at the two side wall surfaces of said hot-dip plating bath so that said members contact said wall surfaces and thereby suppressing the flow of hot dip metal ascending or descending along the wall surfaces.

5. A system for prevention of stirred up dross in continuous hot-dip plating bath of a metal sheet as set forth in any one of claims 1 to 4 characterized in that a width dimension W of the flow regulating members placed at the side wall surfaces of said hot-dip plating bath is shorter than a distance X from said side wall surfaces to ends of the steel sheet and longer than a distance Z from said side wall surfaces to support members of the sink roll.

6. A system for prevention of stirred up dross in continuous hot-dip plating bath of a metal sheet as set forth in any one of claims 1 to 4 characterized in that a depth dimension L of a flow regulating member set at a side wall surface of said hot-dip plating bath is longer than 0.7 time the sink roll diameter and shorter than a depth dimension Y of the inside of the hot-dip plating bath.

7. A system for prevention of stirred up dross in a continuous hot-dip plating bath of a metal sheet as set forth in claim 5, wherein a depth dimension L of a flow regulating member set at a side wall surface of said hot-dip plating bath is longer than 0.7 times the sink roll diameter and shorter than a depth dimension Y of the inside of the hot-dip plating bath.

8. A system for prevention of stirred up dross in a continuous hot-dip plating bath of a metal sheet as set forth in any one of claims 1 to 4, wherein a total of the areas of the holes in each flow regulating member is 10 to 70% of a total area of the flow regulating member.

9. A system for prevention of stirred up dross in a continuous hot-dip plating bath of a metal sheet as set forth in claim 5, wherein a total of the areas of the holes in each flow regulating member is 10 to 70% of a total area of the flow regulating member.

10. A system for prevention of stirred up dross in a continuous hot-dip plating bath of a metal sheet as set forth in claim 6, wherein a total of the areas of the holes in each flow regulating member is 10 to 70% of the total area of the flow regulating member.

11. A system for prevention of stirred up dross in a continuous hot-dip plating bath of a metal sheet as set forth in any one of claims 1 to 4, wherein said flow regulating members have an average area per hole of $1.2\times10^4$ $mm^2$ or less.

12. A system for prevention of stirred up dross in a continuous hot-dip plating bath of a metal sheet as set forth in claim 5, wherein said flow regulating members have an average area per hole of $1.2\times10^4$ $mm^2$ or less.

13. A system for prevention stirred up dross in a continuous hot-dip plating bath of a metal sheet as set forth in claim 6, wherein said flow regulating members have an average area per hole of $1.2\times10^4$ $mm^2$ or less.

14. A system for prevention of stirred up dross in a continuous hot-dip plating bath of a metal sheet as set forth in claim 7, wherein said flow regulating members have an average area per hole of $1.2\times10^4$ $mm^2$ or less.

15. A system for prevention of stirred up dross in a continuous hot-dip plating bath of a metal sheet as set forth in claim 8, wherein said flow regulating members have an average area per hole of $1.2\times10^4$ $mm^2$ or less.

16. A system for prevention of stirred up dross in a continuous hot-dip plating bath of a metal sheet as set forth in claim 9, wherein said flow regulating members have an average area per hole of $1.2\times10^4$ $mm^2$ or less.

17. A system for prevention of stirred up dross in a continuous hot-dip plating bath of a metal sheet as set forth in claim 10, wherein said flow regulating members have an average area per hole of $1.2\times10^4$ $mm^2$ or less.

* * * * *